United States Patent [19]

Webb et al.

[11] 4,371,447

[45] Feb. 1, 1983

[54] LOW VISCOSITY WATER-IN-OIL MICROEMULSIONS

[75] Inventors: Thomas H. Webb, Solon; Hugh F. Vest, Parma; Keng S. Chan, South Euclid, all of Ohio

[73] Assignee: Standard Oil Company, Cleveland, Ohio

[21] Appl. No.: 280,413

[22] Filed: Jul. 6, 1981

[51] Int. Cl.[3] ..... C09K 5/00

[52] U.S. Cl. ..... 252/73; 252/78.5; 252/75; 252/49.5; 252/309

[58] Field of Search ..... 252/309, 49.5, 8.55 D, 252/73

[56] References Cited

U.S. PATENT DOCUMENTS

| | | | |
|---|---|---|---|
| 3,117,929 | 1/1964 | McCoy | 252/73 |
| 3,649,538 | 3/1972 | Hotten | 252/49.5 |
| 3,933,661 | 1/1976 | Abrams | 252/32.5 |
| 4,022,699 | 5/1977 | Holm | 252/309 |

*Primary Examiner*—Sam Silverberg

*Attorney, Agent, or Firm*—Gary R. Plotecher; Herbert D. Knudsen; Larry W. Evans

[57] ABSTRACT

Water-in-oil microemulsions useful as fire-resistant hydraulic fluids are prepared from an oil, such as mineral oil, water, emulsifiers, and an aliphatic diol, such as 2-ethyl-1,3-hexanediol.

8 Claims, No Drawings

LOW VISCOSITY WATER-IN-OIL MICROEMULSIONS

BACKGROUND OF THE INVENTION

1. Field of the Invention

This invention relates to microemulsions. In one aspect, the invention relates to water-in-oil microemulsions while in another aspect, the invention relates to the use of certain of these emulsions as fire-resistant hydraulic fluids. In yet another aspect, the invention relates to the use of a group of aliphatic diols as viscosity reducers in water-in-oil microemulsions.

2. Description of the Prior Art

Microemulsions, sometimes referred to as micellar emulsions, soluble oils, swollen micelles, etc., are not new and have been relatively well discussed in the literature. See for example *Technology of Micellar Solutions* by W. C. Tosch, Paper No. SPE 1847-b, Society of Petroleum Engineers of AIME (American Institute of Mining, Metallurgical and Petroleum Engineers, Inc., 1967) and *Emulsions and Emulsion Technology* by Prince, pp 125–179 (Marcell Dekker, Inc., 1974). Water-in-oil microemulsions are typically characterized as clear, bright and transparent, these characteristics due to the fact that the swollen micelle is typically smaller than the wave length of visible light and thus diffraction does not occur. If the swollen micelle is large enough however, diffraction of short wave length, ultraviolet light can be detected instrumentally.

The small size of the swollen micelles imparts properties to microemulsions that are not found in other fluid systems, particularly macroemulsions. Microemulsions are typically less viscous than macroemulsions formed from the same base oil at constant water content and indeed, the viscosity of a microemulsion reflects the viscosity of its base oil while the viscosity of a macroemulsion is independent of the viscosity of its base oil. Consequently, the viscosity of a microemulsion can be controlled, at least to some extent, by proper selection of the base oil. This is important in a number of different applications, one of which is hydraulic fluids.

Unfortunately, as the water content of a microemulsion increases, the viscosity also increases. At low water content, an equilibrium is established between the micelles, the dissolved surfactant monomer and the swollen micelles. As more water is added, the surfactant is required to generate new swollen micelles and the existent pool of monomer micelle is soon depleted. If additional water is added, then the viscosity will increase because the swollen micelles are enlarged. Eventually, a macroemulsion will result and the viscosity will increase dramatically. A higher surfactant concentration can delay the onset of a viscosity increase due to this mechanism but lyotropic liquid crystals will be formed at the higher surfactant content. These crystals are most readily observed by the large viscosity increase they generally cause. Many such systems are in fact gels.

In the past, low molecular weight alcohols have been used to destroy lyotropic liquid crystals and to reduce the viscosity of a microemulsion. The alcohol molecules participate with the surfactant in forming an interphase between the water and the oil and they are absorbed through the aid of the surfactant onto the surface of the water. Their inclusion reduces the rigidity of the interphase thus making the micelles more pliable in reducing the bulk viscosity. Moreover, the presence of the alcohol molecules will prevent or retard the formation of liquid crystals. Alcohols that have been found useful for this purpose include those marketed under the trade names of Cellosolve ®, Propasol ® and Carbitol ® (all of which are various forms of glycol ethers). Garner et al., U.S. Pat. No. 2,606,874, teaches the use of 1,2-alkanediols for this purpose. While these alcohols do reduce the viscosity of a microemulsion, they are not completely satisfactory for use in microemulsions designed for fire-resistant hydraulic fluids.

Fire-resistant hydraulic fluids are used in hot operations such as metal casting, hot forging, steel reduction mills, etc. These fluids are typically circulated under pressure to hot spots in the system where they absorb heat and the fluid is then returned to a sump where pressure is released. Flash vaporization of water can occur in release of pressure and high sump temperatures cause rapid water loss. The alcohols presently in use for reducing the viscosity of microemulsions generally cannot tolerate evaporative water loss under thermal stress due to either steam distillation or azeotrope formation. Loss of water under these conditions can destroy the microemulsion and thus the utility of the fluid for its intended purpose. As a consequence, there is a need to identify a group of alcohols that will form water-in-oil microemulsions that are stable under thermal stress and to formulate improved fire-resistant hydraulic fluids.

SUMMARY OF THE INVENTION

According to this invention, water-in-oil microemulsions comprising an oil phase, an aqueous phase and a viscosity reducing alcohol are improved by using as the alcohol an aliphatic diol of the formula $$R-\underset{\underset{OH}{|}}{CH}\left(CHR'\right)_n\underset{\underset{OH}{|}}{CH}-R'' \qquad (I)$$

where

R and R'' are independently hydrogen or a $C_1$–$C_{18}$ aliphatic group, each R' is independently hydrogen or a $C_1$–$C_{20}$ aliphatic group, n is an integer of 1–4, with the provisoes that the number of carbon atoms in R is different than the number of carbon atoms in R'', and the total number of carbon atoms in I is from 5 to about 25.

Water-in-oil microemulsions containing these aliphatic diols have exceptionally good thermal stress characteristics and are particularly useful as fire-resistant hydraulic fluids. Moreover, as compared to similar macroemulsions, these microemulsions demonstrate better stability (both in use and storage), lower viscosity, better resistance to microbial growth, and better compatibility with the filtration equipment of hydraulic systems.

DETAILED DESCRIPTION OF THE INVENTION

Oil Phase:

Any material known as an "oil", i.e. any of the numerous, usually combustible substances that are liquid or easily liquifiable at room temperature by warming and are essentially insoluble in water, can be employed as the basis of the oil phase. The source of the oil is unimportant and includes such diverse sources as animal, vegetable, mineral or synthetic manufacture. Moreover, the composition of the oil is also not critical and can be composed of such diverse materials as predominantly hydrocarbons, such as mineral and petroleum oils, fatty acid esters, fats, silicon oils, etc. For preparing fire-resistant hydraulic fluids, mineral oils are generally preferred. The oil phase can also contain one or more additives used to impart certain properties to the microemulsion, such as biocides, oxidation inhibitors, etc.

Aqueous Phase:

The term "aqueous phase" here means the water portion of the microemulsion and any additive that it may contain, such as rust inhibitors, oxidation inhibitors, anti-wear agents, etc.

Emulsifiers/Aliphatic diols:

Any emulsifier can be employed in this invention whether it be nonionic, anionic, cationic or amphoteric. As is well known, not all emulsifiers are effective in forming microemulsions from all types of organic liquids and thus it is necessary to select as the emulsifier or combination of emulsifiers those which have the capability of forming a microemulsion from the oil selected. Other than this, there is no limitation on the nature of the emulsifier(s) which can be used in the practice of this invention.

At least one of the emulsifiers used in this invention is an aliphatic diol of formula I. When both R and R'' are hydrogen and n is 1 or 2, preferably at least one R' is a $C_4$–$C_{18}$ alkyl group. Preferred diols are those where R and R'' are independently $C_1$–$C_4$ alkyl groups when n is 1 or 2. When n is 1, R' is preferably a $C_1$–$C_3$ alkyl group and when n is 2, one R' is preferably hydrogen and the other is preferably a $C_1$–$C_3$ alkyl group. The total number of carbon atoms in the aliphatic diol is preferably from 7 to 15 carbon atoms and when both R and R'' are aliphatic groups, preferably one has at least two more carbon atoms than the other. R, R' and R'' can each contain substituents, such as alicyclic and aromatic groups, sulfur-containing moieties, etc., as desired. 2-ethyl-1,3-hexanediol is a preferred aliphatic diol.

Examples of emulsifiers other than those of formula I which have been found useful in the formation of microemulsions include fatty acid diethanolamides, ethoxylated fatty oils, such as ethoxylated castor oil, ethoxylated alkyl and dialkyl phenols in which the alkyl group has from 6 to 22 carbon atoms, sodium petroleum sulfonate, sodium dioctyl sulfosuccinate, synthetic sodium sulfonates, the isopropylamine salt of dodecylbenzene sulfonic acid, imidazoline derivatives, oleic oxazoline acetate and other organic acid salts, oleyl and coco hydroxyethyl imidazolines, etc. Frequently it is necessary to employ a combination of emulsifiers to provide sufficient emulsification capacity to form the desired microemulsion.

Preparation and Use:

The microemulsions of this invention can be prepared by any known method. The relative proportions of ingredients can vary widely and are generally tailored to specific end uses. In this regard, microemulsions useful as fire-resistant hydraulic fluids typically contain between about 10 and about 50 weight percent oil, between about 12 and about 40 weight percent emulsifier, between about 1 and about 15 weight percent aliphatic diol, and between about 20 and about 70 weight percent water, all based upon the total weight of the composition. Preferably, the composition contains between about 15 and about 35 weight percent oil, between about 21 and about 33 weight percent emulsifier, between about 5 and about 9 weight percent aliphatic diol, and between about 37 and about 50 weight percent water. In one embodiment of this invention, the fire-resistant hydraulic fluids comprise:

| Ingredient | Amount, weight percent based on total weight of fluid | | |
|---|---|---|---|
| | Broad | Preferred | Optimal |
| Mineral oil plus additives | 10–50 | 15–35 | 15–25 |
| Petronate ® HL | 5–30 | 10–25 | 12–20 |
| GAFAC ® RM-410 | 3–12 | 5–10 | 7–9 |
| 2-Ethyl-1,3-Hexanediol | 1–15 | 5–12 | 8–11 |
| Water plus additives | 20–70 | 37–50 | 40–50 |

Oil additives include Irgalube ® TPPT (triphenylphosphorothionate), Irgalube ® 349 (an amine phosphate), Irganox ® L-57 (mixed alkyldiphenylamines), Synkad ® 200 (boramide of an alkanolamine), Bioban ® P-1487 (mixture of complex amines including 4-(2-nitrobutyl) morpholine and 4,4'-(2-ethyl-2-nitrotrimethylene) di-morpholine), Lubrizol ® 5119 (sulfur-phosphorus type ashless anti-wear additive), etc. while water additives include Cobratec ® 99 (benzotriazole), sodium hydroxide, etc. Petronate ® HL is a sodium petroleum sulfonate with a molecular weight of about 440–470 and GAFAC ® Rm-410 is a phosphate ester-/acid formed by treatment of dioctylphenol ethoxylate (40% ethylene oxide) with $P_2O_5$ to afford a mixture of mono and diesters of phosphoric acid.

In a specific embodiment of this invention, the fire-resistant hydraulic fluids comprise:

| Ingredient | Amount, weight percent based on total weight of fluid | |
|---|---|---|
| | Preferred | Optimal |
| HPO-70* | 15–20 | 17–18 |
| Irgalube ® TPPT | 0.1–3 | 0.5–2 |
| Irgalube ® 349 | 0.01–1 | 0.05–0.5 |
| Irganox ® L-57 | 0.01–1 | 0.05–0.5 |
| Synkyd ® 200 | 0.1–3 | 1–2 |
| Bioban ® P-1487 | 0.01–1 | 0.05–0.5 |
| Petronate ® HL | 10–20 | 13–17 |
| GAFAC ® RM-410 | 5–10 | 7–9 |
| 2-Ethyl-1,3-hexanediol | 5–15 | 8–12 |
| 50% NaOH solution | 0.1–3 | 0.5–1.5 |
| Cobratec ® 99 | 0.01–1 | 0.05–0.5 |
| Water | 65–23 | 53–37 |

*HPO-70 is a hydrogenated mineral oil (70 SUS/100).

The microemulsions of this invention are used in the same manner as known microemulsions (and many macroemulsions) and particularly, the fire-resistant hydraulic fluids of this invention are used in the same manner as known fire-resistant hydraulic fluids. However, the fire-resistant hydraulic fluids of this invention either eliminate or minimize many problems that exist with the use of macroemulsions as fire-resistant hydraulic fluids. For example, macroemulsions are not thermodynamically stable and consequently emulsified water particles are constantly agglomerating and eventually the macroemulsion will separate. However, microemulsions are stable and thus can be stored for relatively long periods of time without phase separation and will maintain an emulsified state while in use. This is because the thermodynamically stable state of a microemulsion is the microemulsion itself.

As another example, filtration problems are common with the use of macroemulsion fluids. Cellulose filters generally cannot be used because water particles wet the cellulose causing it to swell and block or restrict oil flow. Other depth filters have very short service life because water induces a similar problem over the long term. As a consequence, edge-type filters generally have to be employed and these are relatively expensive. In contrast, microemulsion fluids can be routinely filtered with inexpensive cellulose filters (due to the fact that their small particle size simply allows them to pass relatively undisturbed through these depth-type filters).

Biological degradation is also a problem with the use of macroemulsion fluids. Contaminating microorganisms must exist in the water droplet and feed on the surrounding oil medium. In macroemulsions the water droplet is typically of sufficient size to easily support one or more microorganisms, but the small size of the water particle in a microemulsion is such that many microorganisms are simply too large to exist in the water droplet.

Finally and as noted earlier, the water-in-oil microemulsions of this invention demonstrate particularly good thermal stress properties which make them particularly well suited for such ends uses as hydraulic fluids, cutting fluids, drawing fluids, and the like.

EXAMPLE

Four variations of a fire-resistant hydraulic fluid were prepared and their formulations are listed in the Table.

TABLE

| Ingredient* | Amount, weight percent based on total weight of composition | | | |
|---|---|---|---|---|
| | 1 | 2 | 3 | 4 |
| SRM ® 6H | 44.65 | 44.65 | 44.90 | 26.55 |
| Lubrizol ® 5111 | 2.00 | 2.00 | 2.00 | 2.00 |
| RD-174 | 0.50 | 0.50 | 0.50 | 0.50 |
| Emulsogen ® BZM | 2.00 | 2.00 | 2.00 | — |
| Diphenylamine | 0.20 | 0.20 | 0.20 | 0.20 |
| Bioban ® P-1487 | 0.15 | 0.15 | 0.20 | 0.15 |
| Petronate ® HL | 15.00 | 15.00 | 7.50 | 15.30 |
| IGEPAL ® CO-430 | 5.00 | 5.00 | 6.20 | 7.80 |
| IGEPAL ® DM-430 | 5.00 | 5.00 | — | — |
| Propasol ® B | — | — | 6.00 | — |
| 2-ethyl-1,3-hexanediol | — | 7.00 | — | 7.00 |
| Water | 25.00 | 25.00 | 30.00 | 40.00 |

*SRM ® 6H—a hydrogenated mineral oil (60 SUS/100);
Lubrizol ® 5111—Zinc DTP type antiwear additive plus rust and oxidation inhibitor,
RD-174—tetrapropenyl succinic anhydride,
Emulsogen ® BZM—combination of an amine salt of alkyl sulphamidocarboxylic acids with partially chlorinated hydrocarbons,
Bioban P-1487—mixture of complex amines including 4-(2-nitrobutyl)morpholine and 4,4'-(ethyl-2-nitrotrimethylene dimorpholine,
Petronate ® HC—sodium petroleum sulfonate with a molecular weight of 440–470,
IGEPAL ® CO-430—nonylphenol ethoxylate (4 moles ethylene oxide per mole nonylphenol),
IGEPAL ® DM-430—dioctylphenol ethoxylate (4 moles ethylene oxide per mole of dioctyphenol),
Propasol ® B—(1-butoxy-2-propanol).

Fluid 1 was void of a viscosity reducing additive at 25% water content and had a viscosity, measured in Saybolt Universal Seconds (SUS), of 420. Fluid 2 was of the same formulation as Fluid 1 but with 7 weight percent 2-ethyl-1,3-hexanediol added and a reduced viscosity (190 SUS). Fluid 3 was a similar fluid except 6 weight percent Propasol ® B was used instead of the hexanediol and it too had a reduced viscosity (160 SUS). Fluid 4 was yet another composition but of 40 weight percent water and containing 7 weight percent of the hexanediol and it too had a reduced viscosity (190 SUS).

To compare the thermal stress properties of fluids 3 and 4, the fluids were tested under conditions to simulate a hot operation, such as those found in metal casting, hot forging, steel reduction mills, etc. The fluid was passed from a reservoir to a hot plate maintained at 190° F. The fluid was made to flow in a thin film across the plate before it was returned to the sump. Water lost by vaporization was replaced with fresh water from an external source. When fluid 3 (containing Proposal ® B) was subjected to this test, the alcohol (Proposal ® B) was removed from the fluid by azeotrope formation and a pronounced solvent odor permeated the area. Since Proposal ® B is a co-emulsifier in the fluid, the microemulsion broke and the fluid formed two separate phases. This occurred when makeup water volume equalled five times the volume of water originally present and due to the phase separation, viscosity measurements were not taken since they would be meaningless.

When fluid 4 (containing 2-ethyl-1,3-hexanediol) was subjected to the test, stability was uneffected after the original water volume had been replaced six times, the original viscosity was unchanged, and no solvent odor was detectible over the entire course of the test.

Although only a few embodiments of this invention are described by the preceding examples, these examples arepurpose of illustration only and are not to be construed as a limitation upon the spirit and scope of the invention.

What is claimed is:

1. A water-in-oil microemulsion comprising:
(a) an oil phase
(b) an aqueous phase
(c) at least one emulsifier, and
(d) at least one aliphatic diol of the formula $$R-\underset{\underset{OH}{|}}{CH}\left(CHR'\right)_n\underset{\underset{OH}{|}}{CH}-R'' \qquad (I)$$

where
R and R'' are independently hydrogen or $C_1$–$C_{18}$ aliphatic groups,
each R' is independently hydrogen or a $C_1$–$C_{20}$ aliphatic group,
n is an integer of 1–4, with the provisoes that
the number of carbon atoms in R is different than the number of carbon atoms in R'', and
the total number of carbon atoms in I is from 5 to about 25.

2. The microemulsion of claim 1 where R and R'' are independently $C_1$–$C_4$ alkyl groups and n is 1 or 2.

3. The microemulsion of claim 2 where when n is 1, R' is a $C_1$–$C_3$ alkyl group and when n is 2, one R' is hydrogen and the other is $C_1$–$C_3$ alkyl group.

4. The microemulsion of claim 3 where the total number of carbon atoms in the diol is from 7–15 carbon atoms.

5. The microemulsion of claim 1 where the diol is 2-ethyl-1,3-hexanediol.

6. The microemulsion of claim 1 having the following formulation:

| Ingredient | Amount weight percent based on total weight of composition |
|---|---|
| Mineral oil | 10–50 |
| Sodium petroleum sulfonate (molecular wt. 440–470) | 5–30 |
| Phosphate ester and/or phosphate acid | 3–12 |

-continued

| Ingredient | Amount weight percent based on total weight of composition |
|---|---|
| 2-ethyl-1,3-hexanediol | 1-5 |
| Water | 20-70 |

7. The microemulsion of claim 1 which has the following composition:

| Ingredient | Amount weight percent based on total weight of fluid |
|---|---|
| Mineral oil | 15-20 |
| Triphenylphosphorothionate | 0.1-3 |
| An amine phosphate | 0.01-1 |
| Mixed alkyldiphenyl amines | 0.01-1 |
| Boramide of an alkanolamine | 0.1-3 |
| A mixture of complex amines including 4-(2-nitrobutyl) morpholine and 4,4'-(2-ethyl-2-nitrotrimethylene) dimorpholine | 0.01-1 |
| Sodium petroleum sulfonate (molecular wt. 440-470) | 10-20 |
| Phosphate ester and/or phosphate acid | -10 |
| 2-ethyl-1,3-hexanediol | -15 |
| 50% sodium hydroxide solution | 0.1-3 |
| Benzotriazole | 0.01-1 |
| Water | 65-23 |

8. The microemulsion of claim 1 where R and R'' are both hydrogen, n is 1 or 2, and R' is a $C_4$-$C_{18}$ alkyl group.

* * * * *